US009469146B2

(12) United States Patent
Bogdanski et al.

(10) Patent No.: US 9,469,146 B2
(45) Date of Patent: Oct. 18, 2016

(54) MOTORIZED POP-UP GREETING CARD

(71) Applicant: American Greetings Corporation, Cleveland, OH (US)

(72) Inventors: Sharon Bogdanski, Solana Beach, CA (US); Annie Deckerd, Elyria, OH (US); John Talbot, Bay Village, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 14/846,855

(22) Filed: Sep. 7, 2015

(65) Prior Publication Data

US 2016/0068003 A1 Mar. 10, 2016

Related U.S. Application Data

(60) Provisional application No. 62/048,121, filed on Sep. 9, 2014.

(51) Int. Cl.

| | |
|---|---|
| ***G09F 1/06*** | (2006.01) |
| ***B42D 15/04*** | (2006.01) |
| ***B42D 15/02*** | (2006.01) |

(52) U.S. Cl.

CPC ..... *B42D 15/042* (2013.01); *B42D 15/02* (2013.01); *B42D 15/022* (2013.01)

(58) Field of Classification Search

CPC B42D 15/022; B42D 15/042; B42D 15/045; G09F 1/00; G09F 1/04; G09F 1/06; G09F 1/08; G09F 2001/085; G09F 27/00; A63H 33/38

See application file for complete search history.

(56) References Cited

U.S. PATENT DOCUMENTS

| | | | | |
|---|---|---|---|---|
| 2,152,299 | A * | 3/1939 | Arndt | G09F 23/00 206/102 |
| 2,565,553 | A | 11/1948 | Foley | |
| 2,609,639 | A * | 9/1952 | Barker | B42D 15/042 446/150 |
| 5,139,454 | A | 8/1992 | Earnest | |
| 5,317,823 | A * | 6/1994 | Brunt, II | G09F 1/08 206/308.1 |
| 5,588,233 | A * | 12/1996 | Volkert | B31D 5/04 40/124.08 |
| 5,864,973 | A | 2/1999 | Cole | |
| 6,460,277 | B1 * | 10/2002 | Tower | A44C 3/001 40/1.5 |
| D617,675 | S | 6/2010 | Underhill | |
| 8,020,325 | B2 | 9/2011 | Ross et al. | |
| 8,615,910 | B2 | 12/2013 | Glass et al. | |
| 2005/0001113 | A1 | 1/2005 | Sullivan et al. | |
| 2009/0126239 | A1 | 5/2009 | Clegg | |
| 2009/0241387 | A1 | 10/2009 | Wong | |
| 2010/0097448 | A1 * | 4/2010 | Gilbert | B60K 35/00 348/51 |
| 2011/0078931 | A1 | 4/2011 | Sapp et al. | |
| 2012/0266504 | A1 | 10/2012 | Michlin | |
| 2013/0139418 | A1 | 6/2013 | Bogdanski et al. | |
| 2013/0139419 | A1 | 6/2013 | Guo et al. | |

* cited by examiner

*Primary Examiner* — Cassandra Davis
(74) *Attorney, Agent, or Firm* — Christine Flanagan

(57) ABSTRACT

The present invention is directed to a greeting card which combines a pop-up element with audio and motor movement. The greeting card contains two different sized pop-up panels which are spaced apart and parallel to one another. Two die cut shapes serve as mobile objects which spin or rotate upon opening the greeting card. The size and placement of the pop-up panels and the mobile objects create a three-dimensional scene. A slide trigger initiates audio playback and motor movement of the mobile objects upon opening the greeting card.

12 Claims, 8 Drawing Sheets

MOTORIZED POP-UP GREETING CARD

RELATED APPLICATIONS

This application claims priority to U.S. Provisional Patent Application No. 62/048,121, filed on Sep. 9, 2014, a copy of which is incorporated herein by reference in its entirety.

FIELD OF THE INVENTION

The present invention is in the field of greeting cards and social expression products. More specifically, the present invention is directed to a motorized pop-up greeting card.

SUMMARY OF THE INVENTION

The present invention is directed to a greeting card which combines a pop-up element with audio and motor movement. The greeting card contains two different sized pop-up panels which are spaced apart and parallel to one another. Two die cut shapes serve as mobile objects which spin or rotate upon opening the greeting card. The size and placement of the pop-up panels and the mobile objects create a three-dimensional scene. A slide trigger initiates audio playback and motor movement of the mobile objects upon opening the greeting card.

DETAILED DESCRIPTION OF PREFERRED AND ALTERNATE EMBODIMENTS

Figure 1:
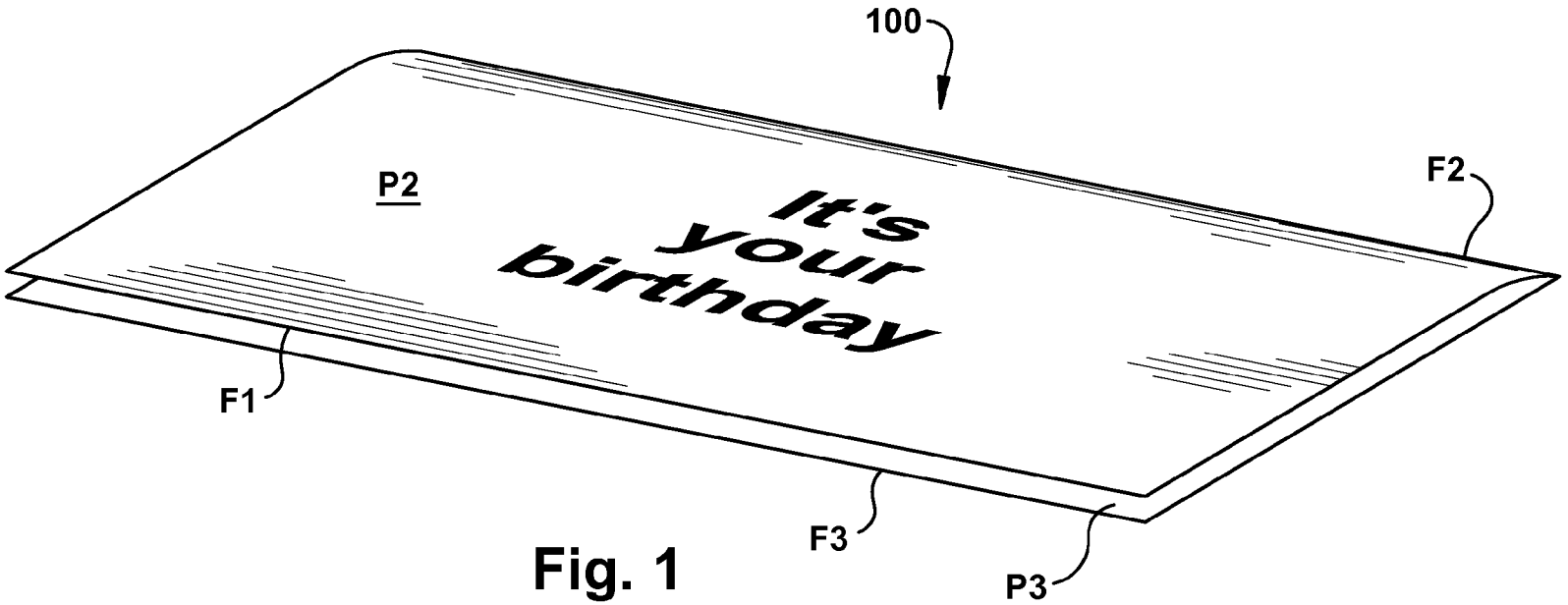
FIG. 1 is a perspective view of a first embodiment of the greeting card of the present invention, in a closed position.
Figure 2:
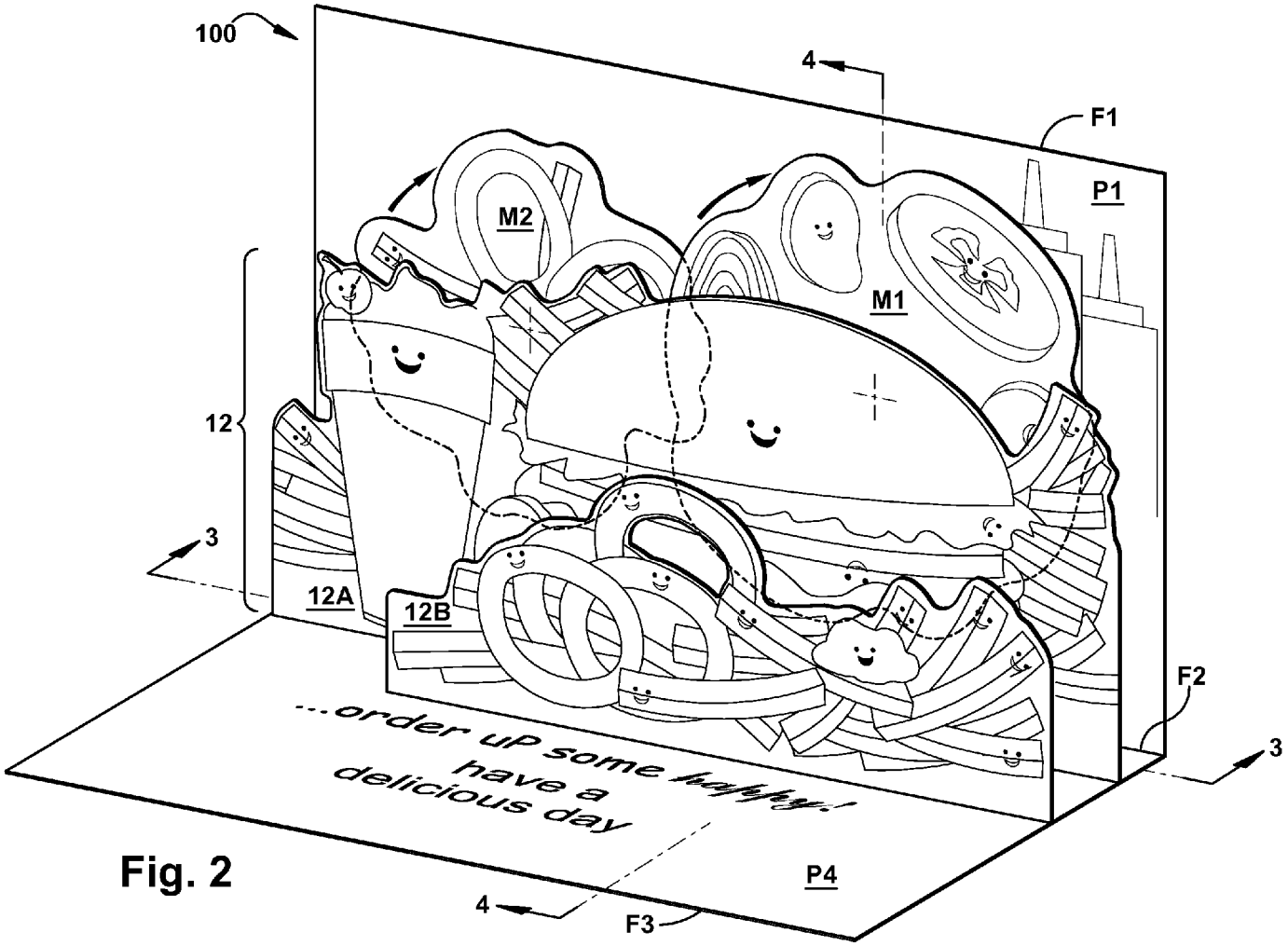
FIG. 2 is a perspective view of the greeting card of FIG. 1, in an open position.
Figure 3:
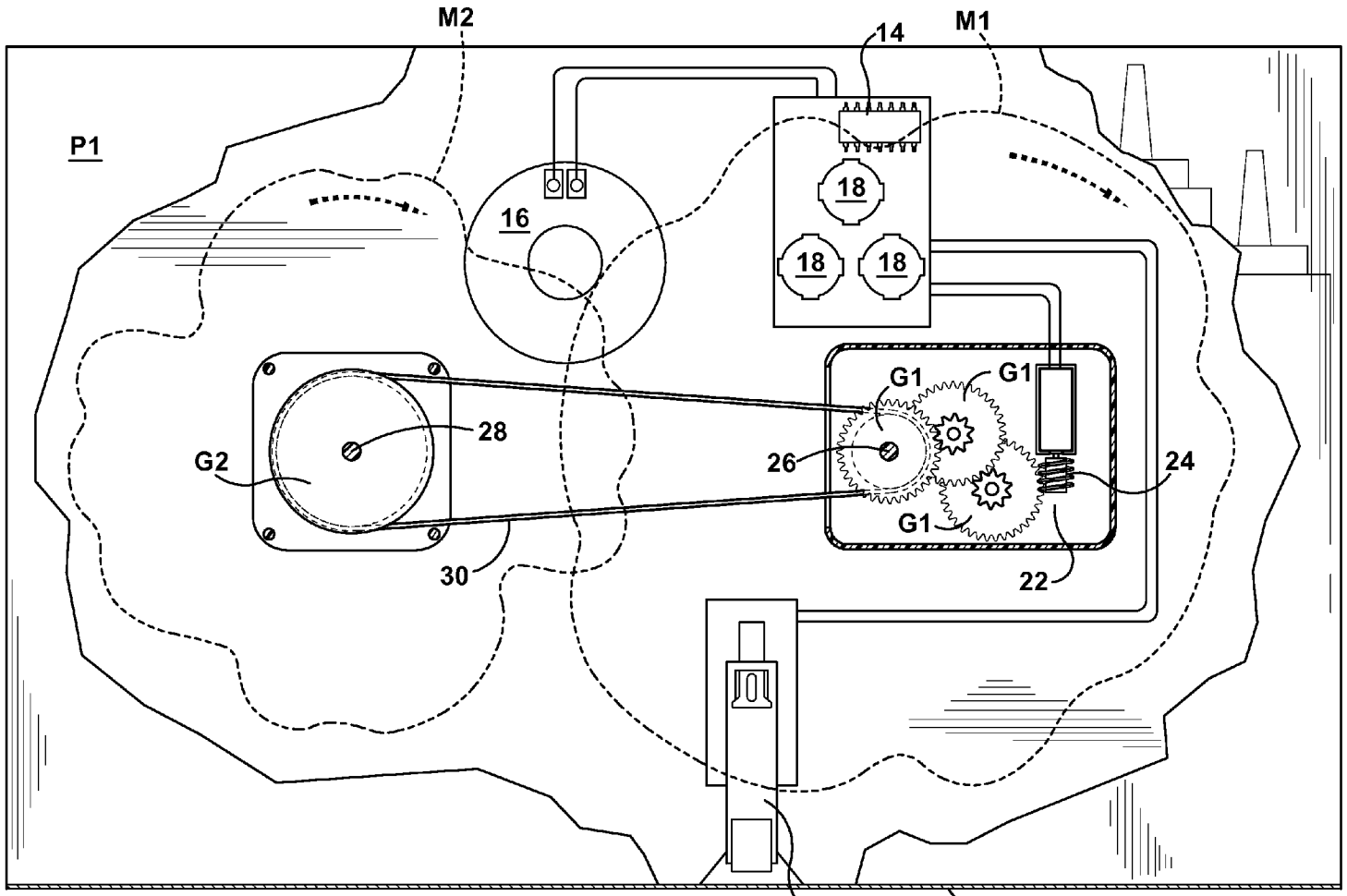
FIG. 3 is a front inside tear-away view of the greeting card of FIG. 2, from the direction of arrows 3-3.
Figure 4:
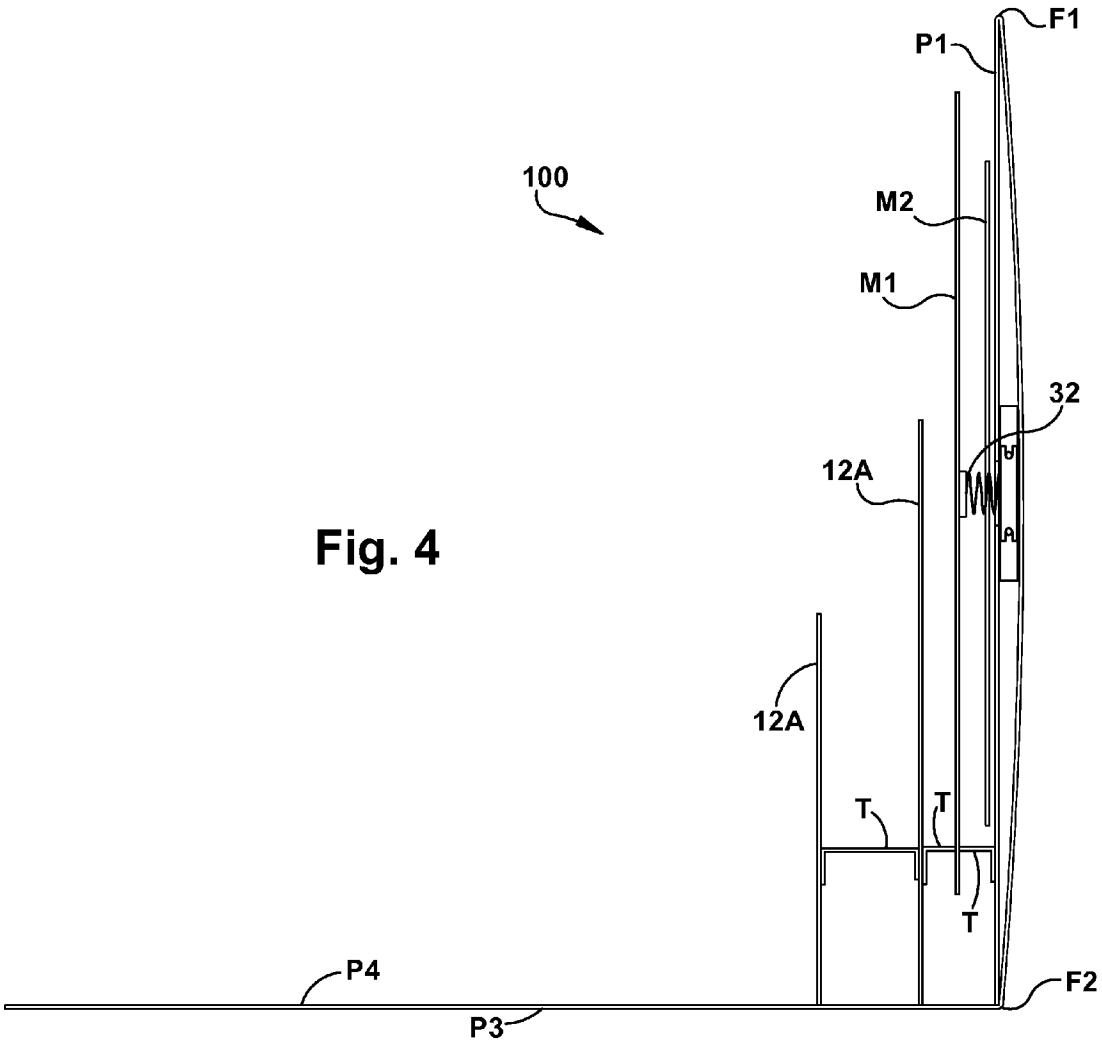
FIG. 4 is a right side view of the greeting card of FIG. 2, from the direction of arrows 4-4.

The greeting card of the present invention combines a greeting card with internal pop-up display and a motorized element. Together the pop-up display and motorized element create a unique and entertaining greeting card presentation.

In a first embodiment, shown in FIGS. 1 through 4, the greeting card of the present invention includes a multi-panel greeting card body having, in a preferred embodiment, four main greeting card panels P1, P2, P3 P4 attached via three horizontal fold lines F1, F2, F3. The first greeting card panel P1 is attached to the second greeting card panel P2 along a first fold line F1. The second greeting card panel P2 is attached to the third greeting card panel P3 along a second fold line F2 and the third greeting card panel P3 is attached to the fourth greeting card panel P4, along third fold line F3. The first greeting card panel P1 is folded about the first fold line F1 to overlap the second greeting card panel P2. The first P1 and second P2 greeting card panels are attached along all free edges, forming a cavity therebetween. The fourth greeting card panel P4 is folded about the third fold line F3 to overlap the third greeting card panel P3. The third P3 and fourth P4 greeting card panels are attached along all free edges to create a cavity therebetween. In a preferred embodiment, the greeting card 100 is horizontally oriented with a front panel which opens upward about a center fold line F2 which horizontally bisects the now two-paneled greeting card 100. With the second or main fold line F2 horizontally bisecting the now two-paneled greeting card 100, the first greeting card panel P1 serves as the inside top or upper panel (inside left panel if the main fold line F2 is positioned vertically along the center of the greeting card) of the greeting card 100. The second greeting card panel P2 serves as the front cover panel of the greeting card 100. The third greeting card panel P3 serves as the rear or back cover panel of the greeting card 100. The fourth greeting card panel P4 serves as the inside bottom or lower panel (inside right panel if the main fold line F2 is positioned vertically along the center of the greeting card). In other embodiments, the greeting card may be vertically oriented with a vertical bisecting fold line and a front cover which opens outward and to the left about the vertical bisecting fold line. The front and rear cover panels are folded along the second or main fold line F2 to open and close the greeting card 100. In the preferred embodiment(horizontal orientation), moving the greeting card 100 to an open position requires pivoting the front cover panel P2 upward about the second or main fold line F2 to reveal the inside of the greeting card 100 or panels P1 (upper inside panel) and P3 (lower inside panel). Opening the greeting card 100 reveals a pop-up structure 12. The pop-up structure 12 includes two separate but interconnected pop-up panels 12A, 12B and at least one mobile object M. In a preferred embodiment, the greeting card 100 contains two mobile objects M1, M2. The pop-up structure 12 is capable of being in a first position when the greeting card 100 is closed, wherein the components of the pop-up structure 12 are folded relatively flat between the first P1 and fourth P4 greeting card panels. When the greeting card 100 is opened, the pop-up structure 12 moves into a second position, wherein the pop-up structure 12 is unfolded, upright and exposed between the two inside panels P1, P4 of the greeting card 100. In a preferred embodiment, the pop-up structure 12 contains two pop-up panels 12A, 12B which are smaller than the main greeting card panels P1, P2, P3, P4. A first pop-up panel 12A is attached to the fourth greeting card panel P4 or bottom inside panel of the greeting card 100 (inside right panel if the greeting card is vertically oriented) proximate to the second or bisecting fold line F2. In a preferred embodiment, the attachment of the first pop-up panel 12A to the fourth greeting card panel P4 may be via one or more tabs which are attached along a lower long horizontal edge of the first pop-up panel 12A via one or more fold lines. The tabs are folded and inserted into one or more corresponding openings or slits contained on the surface of the fourth greeting card panel P4. Alternatively, the one or more tabs may be glued or otherwise permanently attached to the fourth greeting card panel P4. The one or more tabs allow the first pop-up panel 12A to bend about the fold line to lie flat against the fourth greeting card panel (inside bottom panel) P4 when the greeting card 100 is in the first closed or folded position. A second pop-up panel 12B is spaced apart from and parallel to the first pop-up panel 12A and also attached to the fourth greeting card panel P4 via one or more tabs, as described above with respect to the first pop-up panel 12A. The second pop-up panel 12B is smaller in both height and width than the first pop-up panel 12A. The first 12A and second 12B pop-up panels are connected to one another via at least one (preferably two) inverted u-shaped connection tabs T. The inverted u-shaped connection tabs T contain two fold lines creating three segments. The inverted u-shaped connection tabs T are attached along one edge segment to the first pop-up panel 12A and along the opposite edge segment to the second pop-up panel 12B. The first pop-up panel 12A is connected to the first greeting card panel or inside upper panel P1 (or inside left hand panel if the greeting card is vertically oriented) of the greeting card 100 via at least one (preferably two) inverted u-shaped connection tabs T, as described above. The connection of the two pop-up panels 12A, 12B and the connection of the two pop-up panels 12A, 12B to the greeting card 100, allow the pop-up structure 12 to unfold and collapse with the opening and closing of the greeting card 100. While the two pop-up panels 12A, 12B may of any shape and have liner or non-linear edges of different varieties. Also, while the connection mechanisms or tabs T are described as having a particular shape, other shapes have been contemplated and are considered to be within the scope of the present invention.

A sound module which is operative to store and playback audio through a speaker is contained and concealed within one of the two cavities of the greeting card 100. A motor module which is operative to cause movement to one or more moving elements attached to the greeting card 100 is also contained within one of the two cavities of the greeting card 100. Electronic components may include, but are not limited to: a printed circuit board 14, an integrated circuit chip, a memory device, a speaker 16, a power source (such as one or more batteries) 18, a switch 20, a motor 22, and related circuitry and wiring. Any other component which is required to or which facilitates audio playback and motor movement, or any other electronic special effect, such as lighting, may be included, such components being known to one with skill in the art. The electronic components of the greeting card 100 may be contained in one of the two cavities of the greeting card 100 or the components may be split among both cavities. In a preferred embodiment, all electronic components are contained within the cavity formed between the first P1 and second P2 greeting card panels. A slide switch 20 positioned across the second or main fold line F2, triggers the sound and motor modules upon opening the greeting card 100. The slide switch 20 includes a contact arm which is biased into engagement with a contact surface connected to the circuit board 14. The slide switch 20 also includes a slide tab that is moveable between a first positon, wherein a portion of the slide tab is intermediate the contact arm and the contact surface connected to the circuit board 14, thereby creating an open circuit, and a second position wherein the greeting card 100 is in an open position and an aperture or opening in the slide tab permits the contact arm to abut the contact surface of the circuit board, thereby creating a closed circuit. The slide tab may be positioned over the main fold line F2 of the greeting card 100 whereby opening the greeting card 100 pulls the slide tab out from between the contact arm and the contact surface connected to the circuit board 14. A subsequent closing of the greeting card 100 moves the slide tab back between the contact arm and the contact surface of the circuit board.

One or more mobile objects M1, M2 are also contained within the greeting card 100 and are powered by the motor module 22. In a preferred embodiment, the mobile objects M1, M2 are two separate die cut shapes which can be formed into, for example, the shape of a flower, a pinwheel, a circle, or any other conceivable shape. In a preferred embodiment, the mobile objects M1, M2 are attached to a motor 22 which is contained in the first cavity (between first P1 and second P2 panels) of the greeting card 100. Both mobile objects M1, M2 are connected to and powered by the same motor 22 (although in other embodiments each mobile object may be connected to and powered by a separate motor). The motor 22 may be of the type having a rotating gear mechanism 24 that when activated turns a one or more circular gears G1 which are attached to a first connection arm or mechanism 26. The first connection arm or mechanism 26 is inserted through first opening in the top inside panel P1 of the greeting card 100 wherein it is attached to a first mobile object M1. One of the one or more circular gears G1 is attached via an elastic band or belt 30 to a second circular gear G2. Movement of the first circular gear G1 by the rotating gear mechanism 24 is extended via the band or belt 30 to the second circular gear G2, which is attached to a second mobile object M2. The second mobile object M2 is attached to the second circular gear G2 via a second connection arm or mechanism 28 which is extended through a second opening in the top inside panel P1 of the greeting card 100. The size of the first G1 and second G2 circular gears may be different thereby causing the gears G1, G2 (and by extension the first M1 and second M2 mobile objects) to rotate at different speeds wherein one gear rotates faster than the other gear. The size of the two mobile objects M1, M2 may be different as well. The two connection arms or mechanisms 26, 28 may also be of differing lengths such that one mobile object is slightly in front of the other mobile object, creating a three-dimensional (3D) effect. Also, one of the mobile objects, M1 or M2, may be connected to the motor 22 via a spring mechanism 32 to keep the two mobile objects M1, M2 from coming into contact with one another or from one mobile object interfering with the movement of the other mobile object. Although the preferred embodiment has been described herein as having only a single motor 22 which powers two mobile objects M1, M2, alternate embodiments may contain additional motors which each power a separate mobile object.

In operation, the second or main fold line F2 of the greeting card 100 horizontally bisects the top and bottom panels of the greeting card 100 and requires the upward movement of the front cover panel P2 about the second or main fold line F2 and away from the back cover panel P3 of the greeting card 100. When the greeting card 100 is in the first or closed position, the two pop-up panels 12A, 12B are folded downward, in a substantially flat position between the two inside greeting card panels P1, P4. The two pop-up panels 12A, 12B are capable of folding flat between the panels via the inverted u-shaped connection tabs T and via the tabs which connect the two pop-up panels 12A, 12B to the inside bottom or lower panel of the greeting card P4 (as described above). When a user moves the greeting card 100 from the first or closed position into a second or opened position by pivoting the front cover panel P2 upward about the second or main fold line F2, the inverted u-shaped connection tabs T between the first 12A and second 12B pop-up panels and between the first pop-up panel 12A and the inside top or upper panel P1 of the greeting card 100 are unfolded, causing the two pop-up panels 12A, 12B to stand upright and perpendicular to the inside bottom or lower panel P4 of the greeting card 100. Since the second pop-up panel 12B is the forward-most panel (away from the second or main fold line F2) and is smaller than the first pop up panel 12A, it conceals a bottom portion of the first pop-up panel 12A (when viewing from a front plan view). The first pop-up panel 12A is smaller than the inside top or upper panel P1 of the greeting card 100 so the first pop-up panel 12A conceals a bottom portion of the inside top or upper panel P1 of the greeting card 100 and a portion of the first and second mobile objects M1, M2 (when viewing from a front plan view). The arrangement of the two pop-up panels 12A, 12B and the two mobile objects M1, M2 having planes at different distances, gives the illusion of a three-dimensional scene, such as for example, a view of a mountain range. Opening the greeting card 100 also triggers the sound module, via the slide switch 20, which causes playback of at least one audio file stored on the memory device. The slide switch 20 also triggers activation of the motor module 22 which causes rotation of the first G1 and second G2 circular gears, thereby effecting rotation of the two mobile objects M1, M2. Each of the greeting card panels P1, P2, P3, P4 and each portion of the pop-up structure 12A, 12B and mobile objects M1, M2 may contain printing thereon containing text sentiment, photos, drawings, or any other type of print. The greeting card panels P1, P2, P3, P4, pop-up structure 12A, 12B and mobile objects M1, M2 may also contain embellishments such as gems, glitter, or any other type of decorative trimming.

While the first embodiment has been described as having four greeting card panels, two pop-up panels and two mobile object, other numbers and configurations have been contemplated and are considered to be within the scope of the invention, such as, for example, two pop-up panels and one mobile object, or one pop-up panel and one mobile object, or one pop-up panel and two mobile objects, or three or more pop-up panels and three or more mobile objects, and various such combinations. Also, a slide trigger has been described herein, however other switches or triggers, as known to one of skill in the art, may be used in addition to or in the place of the slide switch. Other trigger mechanisms may include a touch sensitive switch, a light sensitive switch, a motion sensitive switch, a magnetic switch, etc.

In a second embodiment of the greeting card of the present invention, shown in FIGS. 5 through 9, the greeting card 200 takes on a larger size and does not include a motor module or any moving elements. The greeting card 200 contains a sound module for storing and replaying at least one audio file and also contains a manual pop-up display 40.

The greeting card body of this embodiment contains a first panel P1 attached to a second panel P2 along a first or main fold line F1, the second panel P2 attached to a third panel P3 along a second fold line F2. The third panel P3 is folded over and attached along each edge to the second panel P2, creating a cavity therebetween. The first panel P1 serves as the front cover of the greeting card 200 and the inside left panel of the greeting card 200. The second panel P2 serves as the back cover of the greeting card 200 and the third panel P3 serves as the inside right panel of the greeting card 200.

Figure 5:
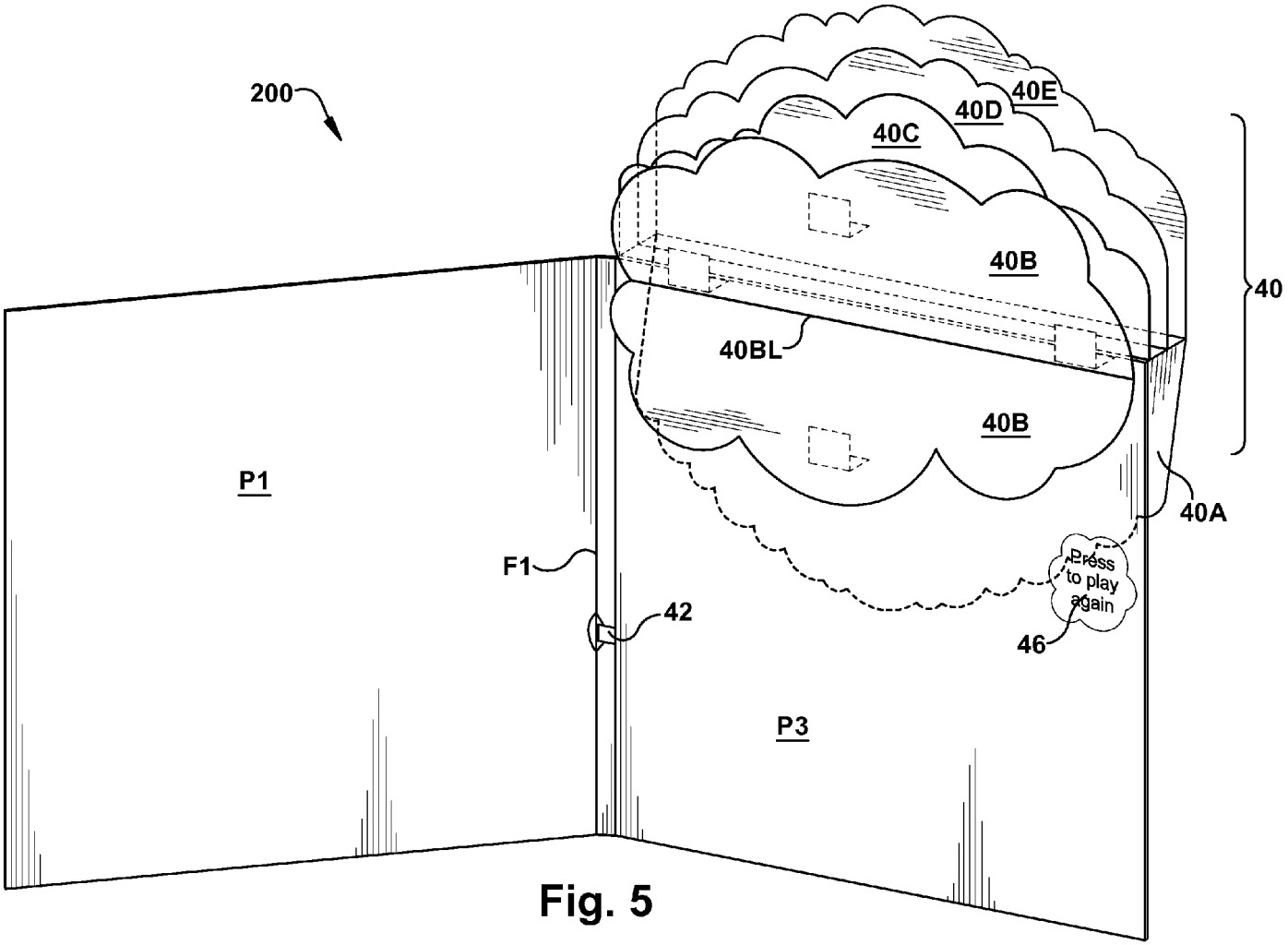
FIG. 5 is a perspective view of a second embodiment of the greeting card of the present invention, in an open position with open flaps
Figure 6:
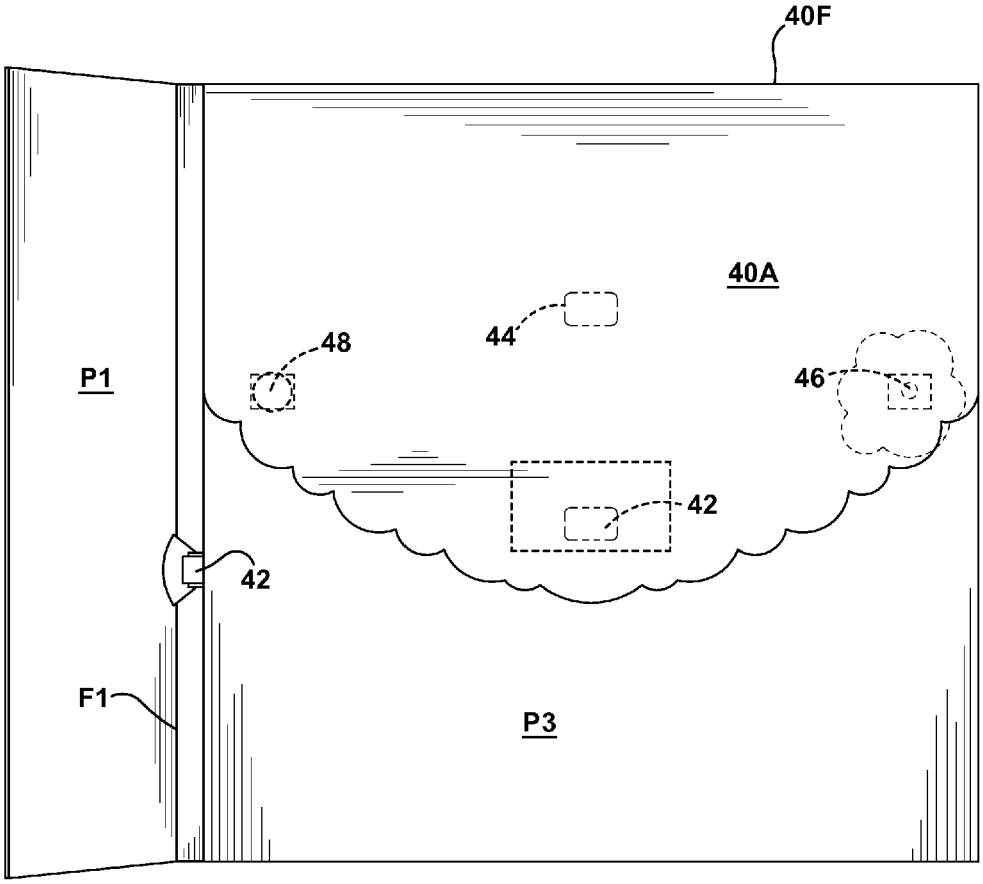
FIG. 6 is a front view of the greeting card of FIG. 5, with closed flaps.
Figure 9:
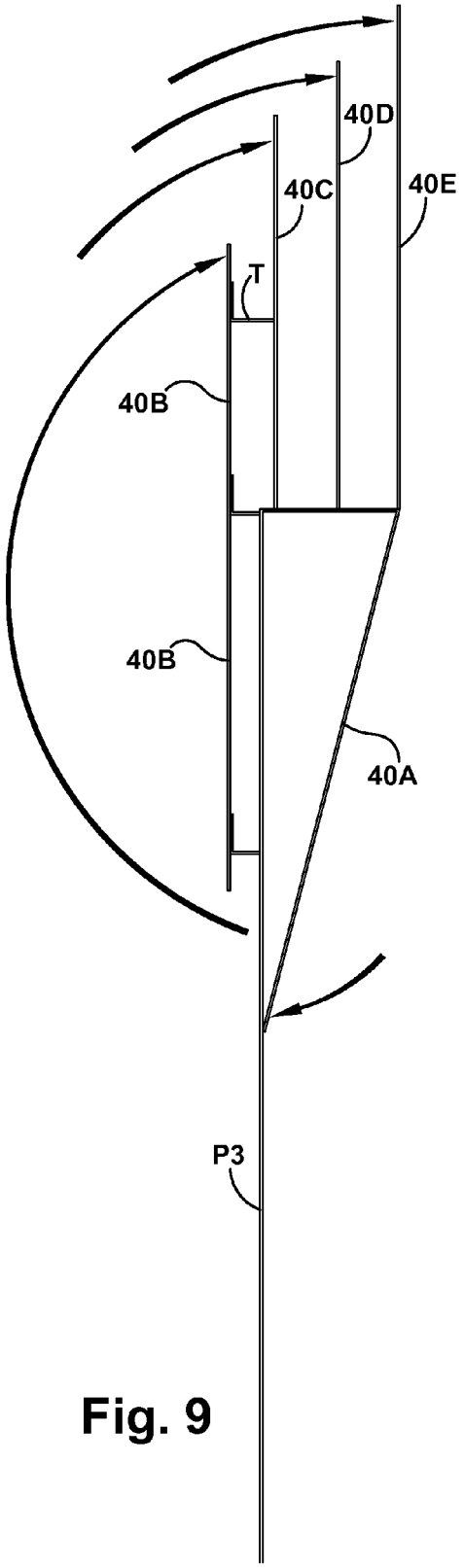
FIG. 9 is a right side view of the greeting card of FIG. 7.

A manual pop-up structure 40 is attached to the third panel P3 or the inside right panel of the greeting card 200. The pop-up structure 40 can be manually moved between a first position wherein the pop-up structure 40 is folded and collapsed, as shown in FIG. 6, and a second position wherein the pop-up structure 40 is unfolded and standing upright, as shown in FIG. 5. The manual pop-up structure 40 contains a base panel 40A and four pop-up panels 40B, 40C, 40D, 40E attached to the base panel 40A. A portion of the base panel 40A is attached to a top section of the third panel P3 or the inside right panel of the greeting card 200. The base panel 40A contains a main fold line 40F such that a top section of the base panel 40A located above the main fold line 40F is folded downward along the main fold line 40F to overly a bottom section of the base panel 40A located below the main fold line 40F. The main fold line 40F is positioned horizontally along the top edge of the inside right panel P3 of the greeting card 200. Therefore, in order to open or unfold the base panel 40A, the top section must be moved in an upward direction pivoting about the main fold line 40F of the base panel 40A. The top section of the base panel 40A contains a first magnet 42 contained therein. A second magnet 44 is contained within the cavity between the second P2 and third P3 greeting card panels such that when the top section of the base panel 40A is folded up and over (wraps around) the second P2 and third P3 greeting card panels, as shown in FIG. 9, the first magnet 42 (located in the base panel 42) attracts and connects with the second magnet 44 creating an attachment point to hold the base panel in place so the four pop-up panels 40B, 40C, 40D, 40E can remain in an upright display position (shown in FIG. 9). Between the top and bottom sections of the folded base panel 40A are contained four pop-up panels 40B, 40C, 40D, 40E. From front to back, each consecutive pop-up panel is larger than the previous pop-up panel. The first pop-up panel 40B contains a bisecting fold line 40BL, creating at top portion and a bottom portion of the first pop-up panel 40B so that when the pop-up structure 40 is in the closed or folded positon, the top portion of the first pop-up panel 40B is folded downward along the bisected fold line 40BL to overly the bottom portion of the first pop-up panel 40B. The second pop-up panel 40C is attached to the first pop-up panel 40B via a first inverted u-shaped connection tab T (described above with respect to the first embodiment). The third pop-up panel 40D is attached to the second pop-up panel 40C via a second inverted u-shaped connection tab T and the fourth pop-up panel 40E is attached to the third pop-up 40D panel via a third inverted u-shaped connection tab T. The fourth pop-up panel 40E is attached to the top section of the base panel 40A via two connection tabs located along a bottom edge of the fourth pop-up panel 40E. The two connection tabs are inserted into two openings or slots contained on the base panel 40A. The two connection tabs of the fourth panel 40E are glued or otherwise permanently attached to the base panel 40A.

Figure 7:
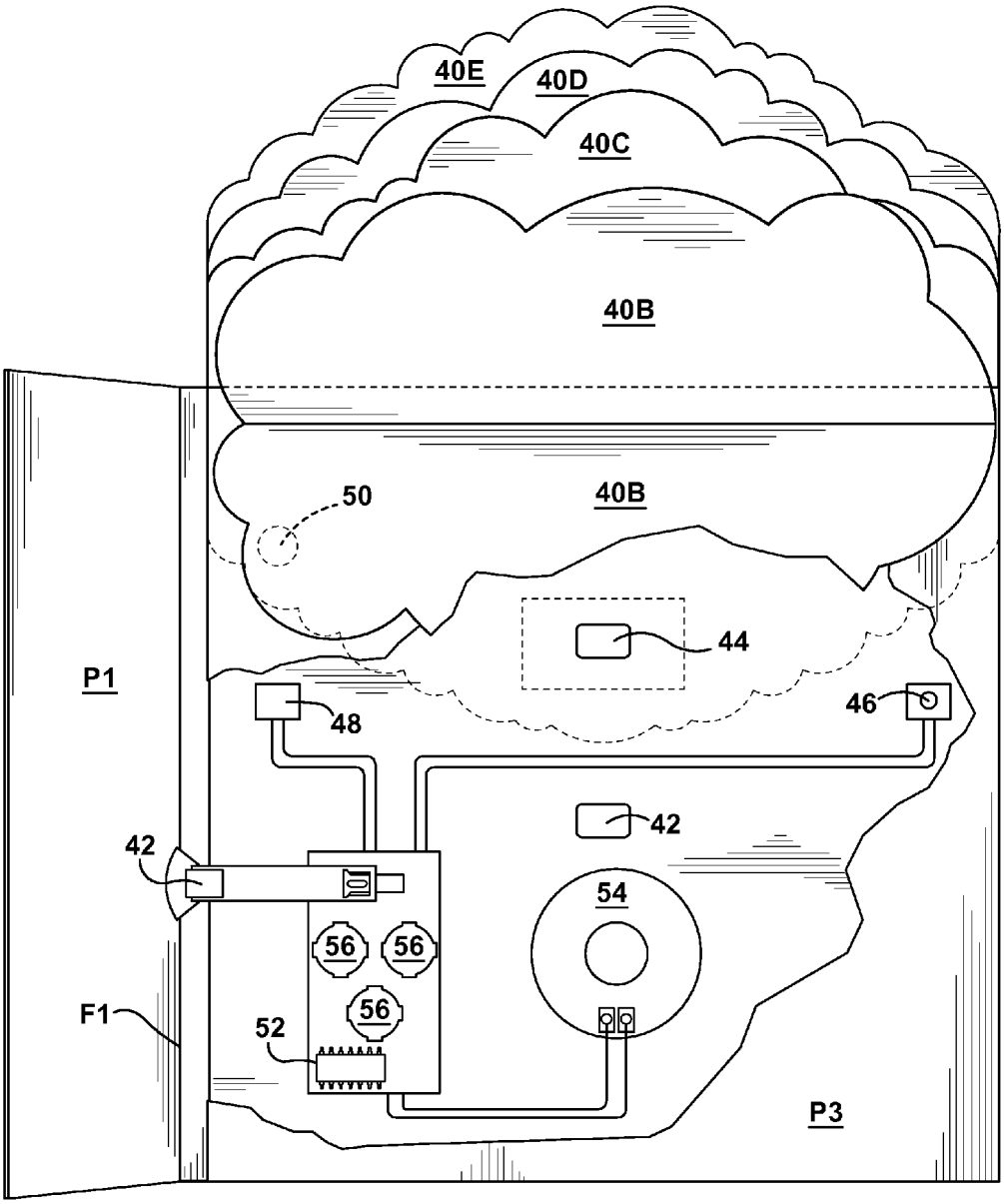
FIG. 7 is a front view of the greeting card of FIG. 5 with open flaps.
Figure 8:
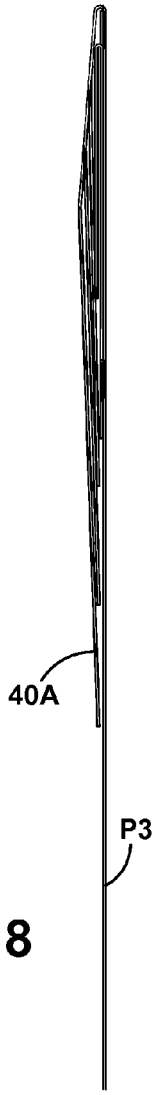
FIG. 8 is a right side view of the greeting card of FIG. 6.

A sound module is contained within the cavity between the second P2 and third P3 greeting card panels. The sound module may contain, but is not limited to: a circuit board 52, an integrated circuit chip, a memory device having at least one audio file saved thereon, a speaker 54, a power source 56, a switch 42, and related circuitry and wiring. The sound module may contain any additional components which enable or facilitate sound storage, recording and production through the speaker 54. Lifting the base panel 40A away from the inside right greeting card panel P3 not only reveals the inner pop-up panels 40B, 40C, 40D, 40E, but it also triggers playback of audio (saved in memory in the sound module). A small metal disk 50 is contained within the upper portion of the base panel 40A. When the base panel 40A is in the closed position, as shown in FIG. 6, the metal disk 50 is in close proximity to a sensor 48, which is contained within the cavity between the second P2 and third P3 greeting card panels. Moving the disk 50 (contained within the base panel 40A) away from the sensor 48 (contained within the cavity between P2 and P3) causes playback of the audio file through the speaker 54. A push button switch 46 is also contained within the cavity between the second P2 and third P3 greeting card panels. A sticker or printing may be contained on the third P3 (or inner right greeting card panel) which directs the user to "press to play again". The push button switch 46 allows a user to replay the audio when the pop-up structure 40 is in the second or open position, as shown in FIG. 7.

In operation, a user opens the greeting card 200 by pivoting the first or cover panel P1 about the first fold line F1 away from the inside right panel P3 of the greeting card 200. A slide switch 42 (as described above with respect to the first embodiment) may be attached across the first fold line F1 such that a first audio clip is replayed upon opening the greeting card 200. The user may then open the manual pop-up structure 40 by lifting the top portion of the base panel 40A (located atop the right inside panel of the greeting card 200) upward. Lifting this top portion of the base panel 40A breaks the connection between the metal disk 50 (contained in the base panel 40A) and the sensor 48 (contained in the cavity between panels P2 and P3), which also serve as a magnetic switch or trigger mechanism, thereby initiating playback of a second audio clip. The four pop up panels 40B, 40C, 40D, 40E are also unfolded such that they are standing upright or perpendicular to the right inside panel P3 of the greeting card 200. The base panel 40A can be folded over the back greeting card panel P2 wherein a first magnet 42 (contained within the base panel 40A) attaches to a second magnet 44 (contained within the cavity between panels P2 and P3) to retain the base panel 40A in the open position, as shown in FIG. 9. Once the second audio clip has been replayed in full, the user can replay the second audio clip while the pop-up structure 40 is in the fully open position (shown in FIG. 9) by pressing the press button 46 (located in the cavity between panels P2 and P3 and accessed through P3). As mentioned above, with respect to the first embodiment, the size and arrangement of the four pop-up panels 40B, 40C, 40D, 40E create a three-dimensional decorative scene within the greeting card 200. The top edges of the pop-up panels 40B, 40C, 40D, 40E may be linear or non-linear such as the scalloped edges as shown in the figures. Closing the manual pop-up structure by folding the top portion of the base panel 40A downward about the main fold line 40F to overly the bottom portion of the base panel 40A and attach to the second magnet 44 contained in the cavity within behind the right inside panel P3 of the greeting card 200, interrupts the circuit thereby deactivating the sound module and ceasing playback of audio. The manual pop-up structure 40 can be opened and closed as many times as desired.

While the greeting card of the present invention has been described herein and shown in the figures with respect to a preferred embodiment, other greeting card shapes, sizes, number of pop-up panels or structures, number of mobile objects, type and number of switch or trigger mechanism, physical orientation of the greeting card, number of sound files, and other such details may be varied and still remain within the scope of the present invention.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A greeting card comprising:

a multi-panel greeting card body;

at least one cavity contained within the multi-panel greeting card body;

a motor module contained in the at least one cavity, the motor module operative to cause rotating movement of two mobile objects attached thereto;

a pop-up structure comprising a first pop-up panel and a second pop-up panel which is parallel to, spaced apart from and partially attached to the first pop-up panel, the first pop-up panel being taller than the second pop-up panel;

the two mobile objects being located behind the first pop-up panel;

wherein opening the greeting card activates the motor module, thereby causing rotational movement of the two mobile objects, and wherein each of the two mobile objects move at different speeds.

2. The greeting card of claim 1 further comprising a sound module having at least one audio file stored thereon.

3. The greeting card of claim 2, wherein opening the greeting card activates the sound module causing playback of the at least one audio file.

4. The greeting card of claim 1, wherein the at two mobile objects are die cut shapes.

5. A greeting card comprising:

a multi-panel greeting card body;

at least one pop-up panel attached the multi-panel greeting card body, the at least one pop-up panel operative to move between a first position wherein it is folded flat between at least two panels of the multi-panel greeting card body and a second position wherein it is unfolded and standing upright;

a motor module operative to cause movement of two mobile objects configured in a side-by-side arrangement, the two mobile objects contained behind and at least partially concealed by the at least one pop-up panel;

wherein opening the greeting card moves the first pop-up panel from the first position to the second position and activates the motor module causing movement of the two mobile objects and, wherein the two mobile objects move at different speeds.

6. The greeting card of claim 5 further comprising a sound module which is operative to store and playback at least one audio file.

7. The greeting card of claim 6, wherein opening the greeting card activates the sound module.

8. The greeting card of claim 5, wherein the greeting card is horizontally oriented such that opening the greeting card requires moving a front cover of the multi-panel greeting card body in an upward direction away from a rear cover of the greeting card.

9. The greeting card of claim 5, wherein the greeting card is horizontally oriented such that opening the greeting card requires moving a front panel of the multi-panel greeting card body in an upward direction about a bisecting fold line.

10. The greeting card of claim 5, wherein the greeting card contains two pop-up panels positioned parallel to one another.

11. A greeting card comprising:

a greeting card body having at least one cavity therein;

a motor module contained within the at least one cavity, the motor module operative to cause movement to at least two mobile objects;

a sound module having at least one audio file contained thereon;

a first pop-up panel attached to the greeting card body, the first pop-up panel operative to move between a first position wherein the first pop-up panel is in a horizontal position and a second position wherein the first pop-up panel is in a vertical position;

a second pop-up panel attached to the greeting card body, the second pop-up panel operative to move between a first position wherein the second pop-up panel is in a horizontal position and a second position wherein the second pop-up panel is in a vertical position;

the at least two mobile objects being located behind and partially concealed by the first pop-up panel when viewing the greeting card from a front plan view;

the first pop-up panel being located behind and partially concealed by the second pop-up panel when viewing the greeting card from a front plan view;

wherein opening the greeting card moves the first and second pop-up panels from the first position to the second position, activates the motor module causing movement to the at least one two mobile objects and activates the sound module causing playback of the at least one audio file, and wherein the at least two mobile objects move at different speeds.

12. The greeting card of claim 11, wherein the two mobile objects are attached to the greeting card body at different distances.

* * * * *